US008869531B2

(12) United States Patent
Held

(10) Patent No.: US 8,869,531 B2
(45) **Date of Patent: *Oct. 28, 2014**

(54) HEAT ENGINES WITH CASCADE CYCLES

(75) Inventor: Timothy James Held, Akron, OH (US)

(73) Assignee: Echogen Power Systems, LLC, Akron, OH (US)

( * ) Notice: Subject to any disclaimer, the term of this patent is extended or adjusted under 35 U.S.C. 154(b) by 339 days.

This patent is subject to a terminal disclaimer.

(21) Appl. No.: 13/305,596

(22) Filed: Nov. 28, 2011

(65) Prior Publication Data

US 2012/0131918 A1 May 31, 2012

Related U.S. Application Data

(63) Continuation-in-part of application No. 12/631,379, filed on Dec. 4, 2009, now Pat. No. 8,096,128.

(60) Provisional application No. 61/243,200, filed on Sep. 17, 2009, provisional application No. 61/316,507, filed on Mar. 23, 2010, provisional application No. 61/417,775, filed on Nov. 29, 2010.

(51) Int. Cl.

| | |
|---|---|
| ***F01K 25/08*** | (2006.01) |
| ***F01K 7/34*** | (2006.01) |
| ***F01K 25/10*** | (2006.01) |
| ***F01K 3/18*** | (2006.01) |

(52) U.S. Cl.

CPC ..... *F01K 25/103* (2013.01); *F01K 3/185* (2013.01); *F24H 2240/12* (2013.01)

USPC ..... 60/651; 60/653; 60/671; 60/677

(58) Field of Classification Search

CPC ..... F01K 25/08; F01K 25/10; F01K 25/103; F01K 3/185; F24H 2240/12; F24H 2240/127

USPC ..... 60/651, 653, 671, 677–679

See application file for complete search history.

(56) References Cited

U.S. PATENT DOCUMENTS

| | | | |
|---|---|---|---|
| 2,575,478 | A | 11/1951 | Wilson |
| 2,634,375 | A | 4/1953 | Guimbal |

(Continued)

FOREIGN PATENT DOCUMENTS

| | | | |
|---|---|---|---|
| CA | 2794150 | A1 | 11/2011 |
| CN | 1165238 | A | 11/1997 |

(Continued)

OTHER PUBLICATIONS

PCT/US2011/029486—International Search Report and Written Opinion dated Nov. 16, 2011.

(Continued)

*Primary Examiner* — Hoang Nguyen

(74) *Attorney, Agent, or Firm* — Edmonds & Nolte, PC

(57) ABSTRACT

Systems and methods for recovering energy from waste heat are provided. The system includes a waste heat exchanger coupled to a source of waste heat to heat a first flow of a working fluid. The system also includes a first expansion device that receives the first flow from the waste heat exchanger and expands it to rotate a shaft. The system further includes a first recuperator coupled to the first expansion device and to receive the first flow therefrom and to transfer heat from the first flow to a second flow of the working fluid. The system also includes a second expansion device that receives the second flow from the first recuperator, and a second recuperator fluidly coupled to the second expansion device to receive the second flow therefrom and transfer heat from the second flow to a combined flow of the first and second flows.

22 Claims, 6 Drawing Sheets

(56) References Cited

U.S. PATENT DOCUMENTS

| | | | | |
|---|---|---|---|---|
| 2,691,280 | A | | 10/1954 | Albert |
| 3,095,274 | A | | 6/1963 | Crawford |
| 3,105,748 | A | | 10/1963 | Stahl |
| 3,237,403 | A | | 3/1966 | Feher |
| 3,277,955 | A | | 10/1966 | Laszlo |
| 3,401,277 | A | | 9/1968 | Larson |
| 3,622,767 | A | | 11/1971 | Koepcke |
| 3,630,022 | A | | 12/1971 | Jubb |
| 3,736,745 | A | | 6/1973 | Karig |
| 3,772,879 | A | | 11/1973 | Engdahl |
| 3,791,137 | A | | 2/1974 | Jubb |
| 3,830,062 | A | | 8/1974 | Morgan et al. |
| 3,939,328 | A | | 2/1976 | Davis |
| 3,971,211 | A | * | 7/1976 | Wethe et al. ..... 60/39.181 |
| 3,982,379 | A | | 9/1976 | Gilli |
| 3,998,058 | A | | 12/1976 | Park |
| 4,009,575 | A | | 3/1977 | Hartman, Jr. |
| 4,029,255 | A | | 6/1977 | Heiser |
| 4,030,312 | A | | 6/1977 | Wallin |
| 4,049,407 | A | | 9/1977 | Bottum |
| 4,070,870 | A | | 1/1978 | Bahel |
| 4,099,381 | A | | 7/1978 | Rappoport |
| 4,119,140 | A | | 10/1978 | Cates |
| 4,150,547 | A | | 4/1979 | Hobson |
| 4,152,901 | A | | 5/1979 | Munters |
| 4,164,848 | A | | 8/1979 | Gilli |
| 4,164,849 | A | | 8/1979 | Mangus |
| 4,170,435 | A | | 10/1979 | Swearingen |
| 4,182,960 | A | | 1/1980 | Reuyl |
| 4,183,220 | A | | 1/1980 | Shaw |
| 4,198,827 | A | | 4/1980 | Terry et al. |
| 4,208,882 | A | | 6/1980 | Lopes |
| 4,221,185 | A | | 9/1980 | Scholes |
| 4,233,085 | A | | 11/1980 | Roderick |
| 4,236,869 | A | | 12/1980 | Luarello |
| 4,248,049 | A | | 2/1981 | Briley |
| 4,257,232 | A | | 3/1981 | Bell |
| 4,287,430 | A | | 9/1981 | Guido |
| 4,336,692 | A | | 6/1982 | Ecker |
| 4,347,711 | A | | 9/1982 | Noe |
| 4,347,714 | A | | 9/1982 | Kinsell |
| 4,372,125 | A | | 2/1983 | Dickenson |
| 4,384,568 | A | | 5/1983 | Palmatier |
| 4,391,101 | A | | 7/1983 | Labbe |
| 4,420,947 | A | | 12/1983 | Yoshino |
| 4,428,190 | A | | 1/1984 | Bronicki |
| 4,433,554 | A | | 2/1984 | Rojey |
| 4,439,687 | A | | 3/1984 | Wood |
| 4,439,994 | A | | 4/1984 | Briley |
| 4,448,033 | A | | 5/1984 | Briccetti |
| 4,450,363 | A | | 5/1984 | Russell |
| 4,455,836 | A | | 6/1984 | Binstock |
| 4,467,609 | A | | 8/1984 | Loomis |
| 4,467,621 | A | | 8/1984 | O'Brien |
| 4,475,353 | A | | 10/1984 | Lazare |
| 4,489,562 | A | | 12/1984 | Snyder |
| 4,489,563 | A | | 12/1984 | Kalina |
| 4,498,289 | A | | 2/1985 | Osgerby |
| 4,516,403 | A | | 5/1985 | Tanaka |
| 4,538,960 | A | | 9/1985 | Iino et al. |
| 4,549,401 | A | | 10/1985 | Spliethoff |
| 4,555,905 | A | | 12/1985 | Endou |
| 4,558,228 | A | | 12/1985 | Larjola |
| 4,573,321 | A | | 3/1986 | Knaebel |
| 4,578,953 | A | | 4/1986 | Krieger |
| 4,589,255 | A | | 5/1986 | Martens |
| 4,636,578 | A | | 1/1987 | Feinberg |
| 4,674,297 | A | | 6/1987 | Vobach |
| 4,694,189 | A | | 9/1987 | Haraguchi |
| 4,697,981 | A | | 10/1987 | Brown et al. |
| 4,700,543 | A | | 10/1987 | Krieger |
| 4,730,977 | A | | 3/1988 | Haaser |
| 4,756,162 | A | | 7/1988 | Dayan |
| 4,765,143 | A | | 8/1988 | Crawford et al. |
| 4,773,212 | A | | 9/1988 | Griffin |
| 4,798,056 | A | | 1/1989 | Franklin |
| 4,813,242 | A | | 3/1989 | Wicks |
| 4,821,514 | A | | 4/1989 | Schmidt |
| 4,867,633 | A | | 9/1989 | Gravelle |
| 4,892,459 | A | | 1/1990 | Guelich |
| 4,986,071 | A | | 1/1991 | Voss |
| 4,993,483 | A | | 2/1991 | Harris |
| 5,000,003 | A | | 3/1991 | Wicks |
| 5,050,375 | A | | 9/1991 | Dickinson |
| 5,083,425 | A | | 1/1992 | Hendriks et al. |
| 5,098,194 | A | | 3/1992 | Kuo |
| 5,102,295 | A | | 4/1992 | Pope |
| 5,104,284 | A | | 4/1992 | Hustak, Jr. |
| 5,164,020 | A | | 11/1992 | Wagner |
| 5,176,321 | A | | 1/1993 | Doherty |
| 5,203,159 | A | | 4/1993 | Koizumi et al. |
| 5,228,310 | A | | 7/1993 | Vandenberg |
| 5,291,960 | A | | 3/1994 | Brandenburg |
| 5,320,482 | A | | 6/1994 | Palmer et al. |
| 5,335,510 | A | | 8/1994 | Rockenfeller |
| 5,358,378 | A | | 10/1994 | Holscher |
| 5,360,057 | A | | 11/1994 | Rockenfeller |
| 5,392,606 | A | | 2/1995 | Labinov |
| 5,440,882 | A | | 8/1995 | Kalina |
| 5,444,972 | A | | 8/1995 | Moore |
| 5,488,828 | A | | 2/1996 | Brossard |
| 5,490,386 | A | | 2/1996 | Keller |
| 5,503,222 | A | | 4/1996 | Dunne |
| 5,531,073 | A | | 7/1996 | Bronicki |
| 5,538,564 | A | | 7/1996 | Kaschmitter |
| 5,542,203 | A | | 8/1996 | Luoma |
| 5,570,578 | A | | 11/1996 | Saujet |
| 5,588,298 | A | | 12/1996 | Kalina |
| 5,600,967 | A | | 2/1997 | Meckler |
| 5,634,340 | A | | 6/1997 | Grennan |
| 5,647,221 | A | | 7/1997 | Garris, Jr. |
| 5,649,426 | A | | 7/1997 | Kalina |
| 5,676,382 | A | | 10/1997 | Dahlheimer |
| 5,680,753 | A | | 10/1997 | Hollinger |
| 5,738,164 | A | | 4/1998 | Hildebrand |
| 5,754,613 | A | | 5/1998 | Hashiguchi et al. |
| 5,771,700 | A | | 6/1998 | Cochran |
| 5,789,822 | A | | 8/1998 | Calistrat |
| 5,813,215 | A | | 9/1998 | Weisser |
| 5,833,876 | A | | 11/1998 | Schnur |
| 5,862,666 | A | | 1/1999 | Liu |
| 5,873,260 | A | | 2/1999 | Linhardt |
| 5,874,039 | A | | 2/1999 | Edelson |
| 5,894,836 | A | | 4/1999 | Wu |
| 5,899,067 | A | | 5/1999 | Hageman |
| 5,903,060 | A | | 5/1999 | Norton |
| 5,918,460 | A | | 7/1999 | Connell |
| 5,941,238 | A | | 8/1999 | Tracy |
| 5,943,869 | A | | 8/1999 | Cheng |
| 5,946,931 | A | | 9/1999 | Lomax |
| 5,973,050 | A | | 10/1999 | Johnson |
| 6,037,683 | A | | 3/2000 | Lulay |
| 6,041,604 | A | | 3/2000 | Nicodemus |
| 6,058,930 | A | | 5/2000 | Shingleton |
| 6,062,815 | A | | 5/2000 | Holt |
| 6,065,280 | A | | 5/2000 | Ranasinghe |
| 6,066,797 | A | | 5/2000 | Toyomura |
| 6,070,405 | A | | 6/2000 | Jerye |
| 6,082,110 | A | | 7/2000 | Rosenblatt |
| 6,105,368 | A | | 8/2000 | Hansen |
| 6,112,547 | A | | 9/2000 | Spauschus |
| 6,129,507 | A | | 10/2000 | Ganelin |
| 6,158,237 | A | | 12/2000 | Riffat |
| 6,164,655 | A | | 12/2000 | Bothien |
| 6,202,782 | B1 | | 3/2001 | Hatanaka |
| 6,223,846 | B1 | | 5/2001 | Schechter |
| 6,233,938 | B1 | | 5/2001 | Nicodemus |
| 6,282,900 | B1 | | 9/2001 | Bell |
| 6,282,917 | B1 | | 9/2001 | Mongan |
| 6,295,818 | B1 | | 10/2001 | Ansley |
| 6,299,690 | B1 | | 10/2001 | Mongeon |
| 6,341,781 | B1 | | 1/2002 | Matz |
| 6,374,630 | B1 | | 4/2002 | Jones |
| 6,393,851 | B1 | | 5/2002 | Wightman |

(56) References Cited

U.S. PATENT DOCUMENTS 6,432,320 B1 8/2002 Bonsignore
6,434,955 B1 8/2002 Ng
6,442,951 B1 9/2002 Maeda
6,446,425 B1 9/2002 Lawlor
6,446,465 B1 9/2002 Dubar
6,463,730 B1 10/2002 Keller
6,484,490 B1 11/2002 Olsen
6,539,720 B2 4/2003 Rouse
6,539,728 B2 4/2003 Korin
6,571,548 B1 6/2003 Bronicki
6,581,384 B1 6/2003 Benson
6,598,397 B2 7/2003 Hanna
6,644,062 B1 11/2003 Hays
6,657,849 B1 12/2003 Andresakis
6,668,554 B1 12/2003 Brown
6,684,625 B2 2/2004 Kline
6,695,974 B2 2/2004 Withers
6,715,294 B2 4/2004 Anderson
6,734,585 B2 5/2004 Tornquist
6,735,948 B1 5/2004 Kalina
6,739,142 B2 5/2004 Korin
6,751,959 B1 6/2004 McClanahan et al.
6,769,256 B1 8/2004 Kalina
6,799,892 B2 10/2004 Leuthold
6,808,179 B1 10/2004 Bhattacharyya
6,810,335 B2 10/2004 Lysaght
6,817,185 B2 11/2004 Coney
6,857,268 B2 * 2/2005 Stinger et al. ..... 60/651
6,910,334 B2 6/2005 Kalina
6,918,254 B2 7/2005 Baker
6,921,518 B2 7/2005 Johnston
6,941,757 B2 9/2005 Kalina
6,960,839 B2 11/2005 Zimron
6,960,840 B2 11/2005 Willis
6,962,054 B1 11/2005 Linney
6,964,168 B1 11/2005 Pierson
6,968,690 B2 11/2005 Kalina
6,986,251 B2 1/2006 Radcliff
7,013,205 B1 3/2006 Hafner
7,021,060 B1 4/2006 Kalina
7,022,294 B2 4/2006 Johnston
7,033,533 B2 4/2006 Lewis-Aburn et al.
7,033,553 B2 4/2006 Johnston et al.
7,036,315 B2 5/2006 Kang
7,041,272 B2 5/2006 Keefer
7,047,744 B1 5/2006 Robertson
7,048,782 B1 5/2006 Couch
7,062,913 B2 6/2006 Christensen
7,096,665 B2 8/2006 Stinger et al.
7,096,679 B2 8/2006 Manole
7,124,587 B1 10/2006 Linney
7,174,715 B2 2/2007 Armitage
7,194,863 B2 3/2007 Ganev
7,197,876 B1 4/2007 Kalina
7,200,996 B2 4/2007 Cogswell
7,234,314 B1 6/2007 Wiggs
7,249,588 B2 7/2007 Russell
7,278,267 B2 10/2007 Yamada
7,279,800 B2 10/2007 Bassett
7,287,381 B1 10/2007 Pierson
7,305,829 B2 12/2007 Mirolli
7,313,926 B2 1/2008 Gurin
7,340,894 B2 3/2008 Miyahara et al.
7,340,897 B2 3/2008 Zimron
7,406,830 B2 8/2008 Valentian et al.
7,416,137 B2 8/2008 Hagen et al.
7,453,242 B2 11/2008 Ichinose
7,458,217 B2 12/2008 Kalina
7,458,218 B2 12/2008 Kalina
7,464,551 B2 12/2008 Althaus et al.
7,469,542 B2 12/2008 Kalina
7,516,619 B2 4/2009 Pelletier
7,600,394 B2 10/2009 Kalina
7,621,133 B2 11/2009 Tomlinson
7,654,354 B1 2/2010 Otterstrom
7,665,291 B2 2/2010 Anand
7,665,304 B2 2/2010 Sundel
7,685,821 B2 3/2010 Kalina
7,730,713 B2 6/2010 Nakano
7,735,335 B2 6/2010 Uno
7,770,376 B1 8/2010 Brostmeyer
7,775,758 B2 8/2010 Legare
7,827,791 B2 11/2010 Pierson
7,838,470 B2 11/2010 Shaw
7,841,179 B2 11/2010 Kalina
7,841,306 B2 11/2010 Myers
7,854,587 B2 12/2010 Ito
7,866,157 B2 1/2011 Ernst
7,900,450 B2 3/2011 Gurin
7,950,230 B2 5/2011 Nishikawa
7,950,243 B2 5/2011 Gurin
7,972,529 B2 7/2011 Machado
7,997,076 B2 8/2011 Ernst
8,096,128 B2 1/2012 Held et al.
8,099,198 B2 1/2012 Gurin
8,146,360 B2 4/2012 Myers
8,281,593 B2 10/2012 Held
8,419,936 B2 4/2013 Berger et al.
2001/0015061 A1 8/2001 Viteri
2001/0020444 A1 9/2001 Johnston
2001/0030952 A1 10/2001 Roy
2002/0029558 A1 3/2002 Tamaro
2002/0066270 A1 6/2002 Rouse et al.
2002/0078696 A1 6/2002 Korin
2002/0078697 A1 6/2002 Lifson
2002/0082747 A1 6/2002 Kramer
2003/0000213 A1 1/2003 Christensen
2003/0061823 A1 4/2003 Alden
2003/0154718 A1 8/2003 Nayar
2003/0182946 A1 10/2003 Sami
2003/0213246 A1 11/2003 Coll et al.
2003/0221438 A1 12/2003 Rane et al.
2004/0011038 A1 1/2004 Stinger
2004/0011039 A1 1/2004 Stinger et al.
2004/0020185 A1 2/2004 Brouillette et al.
2004/0020206 A1 2/2004 Sullivan et al.
2004/0021182 A1 2/2004 Green et al.
2004/0035117 A1 2/2004 Rosen
2004/0083731 A1 5/2004 Lasker
2004/0083732 A1 5/2004 Hanna et al.
2004/0088992 A1 5/2004 Brasz et al.
2004/0097388 A1 5/2004 Brask et al.
2004/0105980 A1 6/2004 Sudarshan et al.
2004/0107700 A1 6/2004 McClanahan et al.
2004/0159110 A1 8/2004 Janssen
2004/0211182 A1 10/2004 Gould
2005/0022963 A1 2/2005 Garrabrant et al.
2005/0056001 A1 3/2005 Frutschi
2005/0096676 A1 5/2005 Gifford, III et al.
2005/0109387 A1 5/2005 Marshall
2005/0137777 A1 6/2005 Kolavennu et al.
2005/0162018 A1 7/2005 Realmuto et al.
2005/0167169 A1 8/2005 Gering et al.
2005/0183421 A1 8/2005 Vaynberg et al.
2005/0196676 A1 9/2005 Singh et al.
2005/0198959 A1 9/2005 Schubert
2005/0227187 A1 10/2005 Schilling
2005/0252235 A1 11/2005 Critoph et al.
2005/0257812 A1 11/2005 Wright et al.
2006/0010868 A1 1/2006 Smith
2006/0060333 A1 3/2006 Chordia et al.
2006/0066113 A1 3/2006 Ebrahim et al.
2006/0080960 A1 4/2006 Rajendran et al.
2006/0112693 A1 6/2006 Sundel
2006/0182680 A1 8/2006 Keefer et al.
2006/0211871 A1 9/2006 Dai et al.
2006/0213218 A1 9/2006 Uno et al.
2006/0225421 A1 10/2006 Yamanaka et al.
2006/0225459 A1 10/2006 Meyer
2006/0249020 A1 11/2006 Tonkovich et al.
2006/0254281 A1 11/2006 Badeer et al.
2007/0001766 A1 1/2007 Ripley et al.
2007/0017192 A1 1/2007 Bednarek et al.
2007/0019708 A1 1/2007 Shiflett et al.

(56) References Cited

U.S. PATENT DOCUMENTS

| | | | | |
|---|---|---|---|---|
| 2007/0027038 | A1 | 2/2007 | Kamimura et al. | |
| 2007/0056290 | A1 | 3/2007 | Dahm | |
| 2007/0089449 | A1 | 4/2007 | Gurin | |
| 2007/0108200 | A1 | 5/2007 | McKinzie, II et al. | |
| 2007/0119175 | A1 | 5/2007 | Ruggieri et al. | |
| 2007/0130952 | A1 | 6/2007 | Copen | |
| 2007/0151244 | A1 | 7/2007 | Gurin | |
| 2007/0161095 | A1 | 7/2007 | Gurin | |
| 2007/0163261 | A1 | 7/2007 | Strathman | |
| 2007/0195152 | A1 | 8/2007 | Kawai et al. | |
| 2007/0204620 | A1 | 9/2007 | Pronske et al. | |
| 2007/0227472 | A1 | 10/2007 | Takeuchi et al. | |
| 2007/0234722 | A1 | 10/2007 | Kalina | |
| 2007/0245733 | A1 | 10/2007 | Pierson et al. | |
| 2007/0246206 | A1 | 10/2007 | Gong et al. | |
| 2008/0000225 | A1 | 1/2008 | Kalina | |
| 2008/0006040 | A1 | 1/2008 | Peterson et al. | |
| 2008/0010967 | A1 | 1/2008 | Griffin | |
| 2008/0023666 | A1 | 1/2008 | Gurin | |
| 2008/0053095 | A1 | 3/2008 | Kalina | |
| 2008/0066470 | A1 | 3/2008 | MacKnight | |
| 2008/0135253 | A1 | 6/2008 | Vinegar et al. | |
| 2008/0163625 | A1 | 7/2008 | O'Brien | |
| 2008/0173450 | A1 | 7/2008 | Goldberg et al. | |
| 2008/0211230 | A1 | 9/2008 | Gurin | |
| 2008/0250789 | A1 | 10/2008 | Myers et al. | |
| 2008/0252078 | A1 | 10/2008 | Myers | |
| 2009/0021251 | A1 | 1/2009 | Simon | |
| 2009/0085709 | A1 | 4/2009 | Meinke | |
| 2009/0107144 | A1 | 4/2009 | Moghtaderi et al. | |
| 2009/0139234 | A1 | 6/2009 | Gurin | |
| 2009/0139781 | A1 | 6/2009 | Straubel | |
| 2009/0173337 | A1 | 7/2009 | Tamaura et al. | |
| 2009/0173486 | A1 | 7/2009 | Copeland | |
| 2009/0180903 | A1 | 7/2009 | Martin et al. | |
| 2009/0205892 | A1 | 8/2009 | Jensen et al. | |
| 2009/0211251 | A1 | 8/2009 | Peterson et al. | |
| 2009/0211253 | A1 | 8/2009 | Radcliff et al. | |
| 2009/0266075 | A1 | 10/2009 | Westmeier et al. | |
| 2009/0293503 | A1 | 12/2009 | Vandor | |
| 2010/0024421 | A1 | 2/2010 | Litwin | |
| 2010/0077792 | A1 | 4/2010 | Gurin | |
| 2010/0083662 | A1 | 4/2010 | Kalina | |
| 2010/0102008 | A1 | 4/2010 | Hedberg | |
| 2010/0122533 | A1 | 5/2010 | Kalina | |
| 2010/0146949 | A1 | 6/2010 | Stobart et al. | |
| 2010/0146973 | A1 | 6/2010 | Kalina | |
| 2010/0156112 | A1 | 6/2010 | Held et al. | |
| 2010/0162721 | A1 | 7/2010 | Welch et al. | |
| 2010/0205962 | A1 | 8/2010 | Kalina | |
| 2010/0218513 | A1 | 9/2010 | Vaisman et al. | |
| 2010/0218930 | A1 | 9/2010 | Proeschel | |
| 2010/0263380 | A1 | 10/2010 | Biederman et al. | |
| 2010/0287934 | A1 | 11/2010 | Glynn et al. | |
| 2010/0300093 | A1 | 12/2010 | Doty | |
| 2010/0326076 | A1 | 12/2010 | Ast et al. | |
| 2011/0027064 | A1 | 2/2011 | Pal et al. | |
| 2011/0030404 | A1 | 2/2011 | Gurin | |
| 2011/0048012 | A1 | 3/2011 | Ernst et al. | |
| 2011/0061384 | A1 | 3/2011 | Held et al. | |
| 2011/0061387 | A1 | 3/2011 | Held et al. | |
| 2011/0088399 | A1 | 4/2011 | Briesch et al. | |
| 2011/0179799 | A1 | 7/2011 | Allam | |
| 2011/0185729 | A1 | 8/2011 | Held | |
| 2011/0192163 | A1 | 8/2011 | Kasuya | |
| 2011/0203278 | A1 | 8/2011 | Kopecek et al. | |
| 2011/0259010 | A1* | 10/2011 | Bronicki et al. | 60/651 |
| 2011/0299972 | A1 | 12/2011 | Morris | |
| 2011/0308253 | A1 | 12/2011 | Ritter | |
| 2012/0047892 | A1* | 3/2012 | Held et al. | 60/652 |
| 2012/0067055 | A1 | 3/2012 | Held | |
| 2012/0128463 | A1 | 5/2012 | Held | |
| 2012/0131918 | A1 | 5/2012 | Held | |
| 2012/0131919 | A1* | 5/2012 | Held et al. | 60/646 |
| 2012/0131920 | A1 | 5/2012 | Held | |
| 2012/0131921 | A1 | 5/2012 | Held | |
| 2012/0159922 | A1 | 6/2012 | Gurin | |
| 2012/0159956 | A1 | 6/2012 | Gurin | |
| 2012/0174558 | A1 | 7/2012 | Gurin | |
| 2012/0186219 | A1 | 7/2012 | Gurin | |
| 2012/0247134 | A1 | 10/2012 | Gurin | |
| 2012/0247455 | A1 | 10/2012 | Gurin et al. | |
| 2012/0261090 | A1 | 10/2012 | Durmaz et al. | |
| 2013/0019597 | A1 | 1/2013 | Kalina | |
| 2013/0033037 | A1 | 2/2013 | Held et al. | |
| 2013/0036736 | A1 | 2/2013 | Hart et al. | |
| 2013/0113221 | A1 | 5/2013 | Held | |

FOREIGN PATENT DOCUMENTS

| | | | |
|---|---|---|---|
| CN | 1432102 | A | 7/2003 |
| CN | 101614139 | A | 12/2009 |
| CN | 202055876 | U | 11/2011 |
| CN | 202544943 | U | 11/2012 |
| CN | 202718721 | U | 2/2013 |
| DE | 2632777 | A1 | 2/1977 |
| DE | 19906087 | A1 | 8/2000 |
| DE | 10052993 | A1 | 5/2002 |
| EP | 1977174 | A2 | 10/2008 |
| EP | 1998013 | A2 | 12/2008 |
| EP | 2419621 | A1 | 2/2012 |
| EP | 2446122 | A1 | 5/2012 |
| EP | 2478201 | A1 | 7/2012 |
| EP | 2500530 | A1 | 9/2012 |
| EP | 2550436 | | 1/2013 |
| GB | 856985 | A | 12/1960 |
| GB | 2010974 | A | 7/1979 |
| GB | 2075608 | A | 11/1981 |
| JP | 58-193051 | A | 11/1983 |
| JP | 60040707 | A | 3/1985 |
| JP | 61-152914 | A | 7/1986 |
| JP | 01-240705 | A | 9/1989 |
| JP | 05-321612 | A | 12/1993 |
| JP | 06-331225 | A | 11/1994 |
| JP | 08028805 | A | 2/1996 |
| JP | 09-100702 | A | 4/1997 |
| JP | 2641581 | B2 | 5/1997 |
| JP | 09-209716 | A | 8/1997 |
| JP | 2858750 | B2 | 12/1998 |
| JP | H11270352 | | 5/1999 |
| JP | 2000257407 | A | 9/2000 |
| JP | 2001-193419 | A | 7/2001 |
| JP | 2002-097965 | A | 4/2002 |
| JP | 2003529715 | A | 10/2003 |
| JP | 2004-239250 | A | 8/2004 |
| JP | 2004-332626 | A | 11/2004 |
| JP | 2005030727 | A | 2/2005 |
| JP | 2005-533972 | | 11/2005 |
| JP | 2005-533972 | A1 | 11/2005 |
| JP | 2006037760 | A | 2/2006 |
| JP | 2006177266 | A | 7/2006 |
| JP | 2007-198200 | | 8/2007 |
| JP | 2007-198200 | A | 9/2007 |
| JP | 4343738 | B2 | 10/2009 |
| JP | 2011-017268 | A | 1/2011 |
| KR | 10-0191080 | B1 | 6/1999 |
| KR | 100191080 | | 6/1999 |
| KR | 10 2007 0086244 | A | 8/2007 |
| KR | 10-0766101 | B1 | 10/2007 |
| KR | 10-0844634 | A | 7/2008 |
| KR | 10-0844634 | B1 | 7/2008 |
| KR | 10-20100067927 | A | 6/2010 |
| KR | 1020110018769 | A | 2/2011 |
| KR | 1069914 | B1 | 1/2012 |
| KR | 1103549 | B1 | 1/2012 |
| KR | 10-2012-0058582 | A | 6/2012 |
| KR | 2012-0068670 | A | 6/2012 |
| KR | 2012/0068670 | A | 6/2012 |
| KR | 2012-0128753 | A | 11/2012 |
| KR | 2012-0128755 | A | 11/2012 |
| WO | WO 91/05145 | A1 | 4/1991 |
| WO | WO 96/09500 | A1 | 3/1996 |
| WO | 0071944 | A1 | 11/2000 |
| WO | WO 01/44658 | A1 | 6/2001 |

(56) References Cited

FOREIGN PATENT DOCUMENTS

| | | | |
|---|---|---|---|
| WO | WO 2006/060253 | | 6/2006 |
| WO | WO 2006/137957 | A1 | 12/2006 |
| WO | WO 2007/056241 | A2 | 5/2007 |
| WO | WO 2007/079245 | A2 | 7/2007 |
| WO | WO 2007/082103 | A2 | 7/2007 |
| WO | WO 2007/112090 | A2 | 10/2007 |
| WO | WO 2008/039725 | A2 | 4/2008 |
| WO | 2008101711 | A2 | 8/2008 |
| WO | 2009-045196 | A1 | 4/2009 |
| WO | WO 2009/058992 | A2 | 5/2009 |
| WO | 2010-074173 | A1 | 7/2010 |
| WO | 2010083198 | A1 | 7/2010 |
| WO | WO 2010/121255 | A1 | 10/2010 |
| WO | WO 2010/126980 | A2 | 11/2010 |
| WO | WO 2010/151560 | A1 | 12/2010 |
| WO | WO 2011/017450 | A2 | 2/2011 |
| WO | WO 2011/017476 | A1 | 2/2011 |
| WO | WO 2011/017599 | A1 | 2/2011 |
| WO | WO 2011/034984 | A1 | 3/2011 |
| WO | WO 2011/094294 | A2 | 8/2011 |
| WO | WO 2011/119650 | A2 | 9/2011 |
| WO | 2012-074905 | A2 | 6/2012 |
| WO | 2012-074907 | A2 | 6/2012 |
| WO | 2012-074911 | A2 | 6/2012 |
| WO | WO 2012/074940 | A2 | 6/2012 |
| WO | WO 2013/055391 | A1 | 4/2013 |
| WO | WO 2013/059687 | A1 | 4/2013 |
| WO | WO 2013/059695 | A1 | 4/2013 |
| WO | WO 2013/070249 | A1 | 5/2013 |
| WO | WO 2013/074907 | A1 | 5/2013 |

OTHER PUBLICATIONS

PCT/US2011/062201—International Search Report and Written Opinion dated Jun. 26, 2012.

PCT/US2011/062207—International Search Report and Written Opinion dated Jun. 28, 2012.

PCT/US2011/062198—International Search Report and Written Opinion dated Jul. 2, 2012.

PCT/US2011/062266—International Search Report and Written Opinion dated Jul. 9, 2012.

PCT/US2011/029486—International Preliminary Report on Patentability dated Sep. 25, 2012.

PCT/US2012/062204—International Search Report and Written Opinion dated Nov. 1, 2012.

Vaclav Dostal, Martin Kulhanek, "Research on the Supercritical Carbon Dioxide Cycles in the Czech Republic", Department of Fluid Mechanics and Power Engineering Czech Technical University in Prague, RPI, Troy, NY, Apr. 29-30, 2009; 8 pages.

Alpy, N., et al., "French Atomic Energy Commission views as regards SCO2 Cycle Development priorities and related R&D approach," Presentation, Symposium on SCO2 Power Cycles, Apr. 29-30, 2009, Troy, NY, 20 pages.

Angelino, G., and Invernizzi, C.M., "Carbon Dioxide Power Cycles using Liquid Natural Gas as Heat Sink", Applied Thermal Engineering Mar. 3, 2009, 43 pages.

Bryant, John C., Saari, Henry, and Zanganeh, Kourosh, "An Analysis and Comparison of the Simple and Recompression Supercritical CO2 Cycles" Supercritical CO2 Power Cycle Symposium, May 24-25, 2011, Boulder, CO, 8 pages.

Chapman, Daniel J., Arias, Diego A., "An Assessment of the Supercritical Carbon Dioxide Cycle for Use in a Solar Parabolic Trough Power Plant", Presentation, Abengoa Solar, Apr. 29-30, 2009, Troy, NY, 20 pages.

Chapman, Daniel J., Arias, Diego A., "An Assessment of the Supercritical Carbon Dioxide Cycle for Use in a Solar Parabolic Trough Power Plant", Paper, Abengoa Solar, Apr. 29-30, 2009, Troy, NY, 5 pages.

Chen, Yang, Lundqvist, P., Johansson, A., Platell, P., "A Comparative Study of the Carbon Dioxide Transcritical Power Cycle Compared with an Organic Rankine Cycle with R123 as Working Fluid in Waste Heat Recovery", Science Direct, Applied Thermal Engineering, Jun. 12, 2006, 6 pages.

Chen, Yang, "Thermodynamic Cycles Using Carbon Dioxide as Working Fluid", Doctoral Thesis, School of Industrial Engineering and Management, Stockholm, Oct. 2011, 150 pages., (3 parts).

Chordia, Lalit, "Optimizing Equipment for Supercritical Applications", Thar Energy LLC, Supercritical CO2 Power Cycle Symposium, May 24-25, 2011, Boulder, CO, 7 pages.

Combs, Osie V., "An Investigation of the Supercritical CO2 Cycle (Feher cycle) for Shipboard Application", Massachusetts Institute of Technology, May 1977, 290 pages.

Di Bella, Francis A., "Gas Turbine Engine Exhaust Waste Heat Recovery Navy Shipboard Module Development", Supercritical CO2 Power Cycle Symposium, May 24-25, 2011, Boulder, CO, 8 pages.

Dostal, V., et al., A Supercritical Carbon Dioxide Cycle for Next Generation Nuclear Reactors, Mar. 10, 2004, 326 pages., (7 parts).

Dostal, Vaclav, and Dostal, Jan, "Supercritical CO2 Regeneration Bypass Cycle—Comparison to Traditional Layouts", Supercritical CO2 Power Cycle Symposium, May 24-25, 2011, Boulder, CO, 5 pages.

Eisemann, Kevin, and Fuller, Robert L., "Supercritical CO2 Brayton Cycle Design and System Start-up Options", Barber Nichols, Inc., Paper, Supercritical CO2 Power Cycle Symposium, May 24-25, 2011, Boulder, CO, 7 pages.

Eisemann, Kevin, and Fuller, Robert L., "Supercritical CO2 Brayton Cycle Design and System Start-up Options", Presentation, Supercritical CO2 Power Cycle Symposium, May 24-25, 2011, Boulder, CO, 11 pages.

Feher, E.G., et al., "Investigation of Supercritical (Feher) Cycle", Astropower Laboratory, Missile & Space Systems Division, Oct. 1968, 152 pages.

Fuller, Robert L., and Eisemann, Kevin, "Centrifugal Compressor Off-Design Performance for Super-Critical CO2", Barber Nichols, Inc. Presentation, Supercritical CO2 Power Cycle Symposium, May 24-25, 2011, Boulder, CO, 20 pages.

Fuller, Robert L., and Eisemann, Kevin, "Centrifugal Compressor Off-Design Performance for Super-Critical CO2", Paper, Supercritical CO2 Power Cycle Symposium, May 24-25, 2011, Boulder, CO, 12 pages.

Gokhstein, D.P. and Verkhivker, G.P. "Use of Carbon Dioxide as a Heat Carrier and Working Substance in Atomic Power Stations", Soviet Atomic Energy, Apr. 1969, vol. 26, Issue 4, pp. 430-432.

Gokhstein, D.P.; Taubman, E.I.; Konyaeva, G.P., "Thermodynamic Cycles of Carbon Dioxide Plant with an Additional Turbine After the Regenerator", Energy Citations Database, Mar. 1973, 1 Page, Abstract only.

Hejzlar, P. et al., "Assessment of Gas Cooled Gas Reactor with Indirect Supercritical CO2 Cycle" Massachusetts Institute of Technology, Jan. 2006, 10 pages.

Hoffman, John R., and Feher, E.G., "150 kwe Supercritical Closed Cycle System", Transactions of the ASME, Jan. 1971, pp. 70-80.

Jeong, Woo Seok, et al., "Performance of S—CO2 Brayton Cycle with Additive Gases for SFR Application", Korea Advanced Institute of Science and Technology, Supercritical CO2 Power Cycle Symposium, May 24-25, 2011, Boulder, CO, 5 pages.

Johnson, Gregory A., & McDowell, Michael, "Issues Associated with Coupling Supercritical CO2 Power Cycles to Nuclear, Solar and Fossil Fuel Heat Sources", Hamilton Sundstrand, Energy Space & Defense-Rocketdyne, Apr. 29- 30, 2009, Troy, NY, Presentation, 18 pages.

Kawakubo, Tomoki, "Unsteady Roto-Stator Interaction of a Radial-Inflow Turbine with Variable Nozzle Vanes", ASME Turbo Expo 2010: Power for Land, Sea, and Air; vol. 7: Turbomachinery, Parts A, B, and C; Glasgow, UK, Jun. 14-18, 2010, Paper No. GT2010-23677, pp. 2075-2084, (1 page, Abstract only).

Kulhanek, Martin, "Thermodynamic Analysis and Comparison of S—CO2 Cycles", Presentation, Czech Technical University in Prague, Supercritical CO2 Power Cycle Symposium, May 24-25, 2011, Boulder, CO, 14 pages.

(56) References Cited

OTHER PUBLICATIONS

Kulhanek, Martin, "Thermodynamic Analysis and Comparison of S—CO2 Cycles", Paper, Czech Technical University in Prague, Supercritical CO2 Power Cycle Symposium, May 24-25, 2011, Boulder, CO, 7 pages.
Kulhanek, Martin., and Dostal, Vaclav, "Supercritical Carbon Dioxide Cycles Thermodynamic Analysis and Comparison", Abstract, Faculty Conference held in Prague, Mar. 24, 2009, 13 pages.
Ma, Zhiwen and Turchi, Craig S., "Advanced Supercritical Carbon Dioxide Power Cycle Configurations for Use in Concentrating Solar Power Systems", National Renewable Energy Laboratory, Supercritical CO2 Power Cycle Symposium, May 24-25, 2011, Boulder, CO, 4 pages.
Moisseytsev, Anton, and Sienicki, Jim, "Investigation of Alternative Layouts for the Supercritical Carbon Dioxide Brayton Cycle for a Sodium-Cooled Fast Reactor", Supercritical CO2 Power Cycle Symposium, Troy, NY, Apr. 29, 2009, 26 pages.
Munoz De Escalona, Jose M., "The Potential of the Supercritical Carbon Dioxide Cycle in High Temperature Fuel Cell Hybrid Systems", Paper, Thermal Power Group, University of Seville, Supercritical CO2 Power Cycle Symposium, May 24-25, 2011, Boulder, CO, 6 pages.
Munoz De Escalona, Jose M., et al., "The Potential of the Supercritical Carbon Dioxide Cycle in High Temperature Fuel Cell Hybrid Systems", Presentation, Thermal Power Group, University of Seville, Supercritical CO2 Power Cycle Symposium, May 24-25, 2011, Boulder, CO, 19 pages.
Muto, Y., et al., "Application of Supercritical CO2 Gas Turbine for the Fossil Fired Thermal Plant", Journal of Energy and Power Engineering, Sep. 30, 2010, vol. 4, No. 9, 9 pages.
Muto, Yasushi, and Kato, Yasuyoshi, "Optimal Cycle Scheme of Direct Cycle Supercritical CO2 Gas Turbine for Nuclear Power Generation Systems", International Conference on Power Engineering-2007, Oct. 23-27, 2007, Hangzhou, China, pp. 86-87.
Noriega, Bahamonde J.S., "Design Method for s—CO2 Gas Turbine Power Plants", Master of Science Thesis, Delft University of Technology, Oct. 2012, 122 pages., (3 parts).
Oh, Chang, et al., "Development of a Supercritical Carbon Dioxide Brayton Cycle: Improving PBR Efficiency and Testing Material Compatibility", Presentation, Nuclear Energy Research Initiative Report, Oct. 2004, 38 pages.
Oh, Chang; et al., "Development of a Supercritical Carbon Dioxide Brayton Cycle: Improving VHTR Efficiency and Testing Material Compatibility", Presentation, Nuclear Energy Research Initiative Report, Final Report, Mar. 2006, 97 pages.
Parma, Ed, et al., "Supercritical CO2 Direct Cycle Gas Fast Reactor (SC-GFR) Concept" Presentation for Supercritical CO2 Power Cycle Symposium, May 24-25, 2011, Boulder, CO, 40 pages.
Parma, Ed, et al., "Supercritical CO2 Direct Cycle Gas Fast Reactor (SC-GFR) Concept", Supercritical CO2 Power Cycle Symposium, May 24-25, 2011, Boulder, CO, 9 pages.
Parma, Edward J., et al., "Supercritical CO2 Direct Cycle Gas Fast Reactor (SC-GFR) Concept", Presentation, Sandia National Laboratories, May 2011, 55 pages.
PCT/US2006/049623—Written Opinion of ISA dated Jan. 4, 2008, 4 pages.
PCT/US2007/001120—International Search Report dated Apr. 25, 2008, 7 pages.
PCT/US2007/079318—International Preliminary Report on Patentability dated Jul. 7, 2008, 5 pages.
PCT/US2010/031614—International Search Report dated Jul. 12, 2010, 3 pages.
PCT/US2010/031614—International Preliminary Report on Patentability dated Oct. 27, 2011, 9 pages.
PCT/US2010/039559—International Preliminary Report on Patentability dated Jan. 12, 2012, 7 pages.
PCT/US2010/039559—Notification of Transmittal of the International Search Report and Written Opinion of the International Searching Authority, or the Declaration dated Sep. 1, 2010, 6 pages.
PCT/US2010/044476—International Search Report dated Sep. 29, 2010, 23 pages.
PCT/US2010/044681—International Search Report and Written Opinion mailed Oct. 7, 2010,10 pages.
PCT/US2010/044681—International Preliminary Report on Patentability dated Feb. 16, 2012, 9 pages.
PCT/US2010/049042—International Search Report and Written Opinion dated Nov. 17, 2010, 11 pages.
PCT/US2010/049042—International Preliminary Report on Patentability dated Mar. 29, 2012, 18 pages.
PCT/US2012/000470—International Search Report dated Mar. 8, 2013, 10 pages.
PCT/US2012/061151—International Search Report and Written Opinion dated Feb. 25, 2013, 9 pages.
PCT/US2012/061159—International Search Report dated Mar. 2, 2013, 10 pages.
Persichilli, Michael, et al.., "Supercritical CO2 Power Cycle Developments and Commercialization: Why sCO2 can Displace Steam" Echogen Power Systems LLC, Power-Gen India & Central Asia 2012, Apr. 19-21, 2012, New Delhi, India, 15 pages.
Saari, Henry, et al., "Supercritical CO2 Advanced Brayton Cycle Design", Presentation, Carleton University, Supercritical CO2 Power Cycle Symposium, May 24-25, 2011, Boulder, CO, 21 pages.
San Andres, Luis, "Start-Up Response of Fluid Film Lubricated Cryogenic Turbopumps (Preprint)", AIAA/ASME/SAE/ASEE Joint Propulsion Conference, Cincinnati, OH, Jul. 8-11, 2007, 38 pages.
Sarkar, J., and Bhattacharyya, Souvik, "Optimization of Recompression S—CO2 Power Cycle with Reheating" Energy Conversion and Management 50 (May 17, 2009), pp. 1939-1945.
Tom, Samsun Kwok Sun, "The Feasibility of Using Supercritical Carbon Dioxide as a Coolant for the Candu Reactor", The University of British Columbia, Jan. 1978, 156 pages.
VGB PowerTech Service GmbH, "CO2 Capture and Storage", A VGB Report on the State of the Art, Aug. 25, 2004, 112 pages.
Vidhi, Rachana, et al., "Study of Supercritical Carbon Dioxide Power Cycle for Power Conversion from Low Grade Heat Sources", Presentation, University of South Florida and Oak Ridge National Laboratory, Supercritical CO2 Power Cycle Symposium, May 24-25, 2011, Boulder, CO, 17 pages.
Vidhi, Rachana, et al., "Study of Supercritical Carbon Dioxide Power Cycle for Power Conversion from Low Grade Heat Sources", Paper, University of South Florida and Oak Ridge National Laboratory, Supercritical CO2 Power Cycle Symposium, May 24-25, 2011, Boulder, CO, 8 pages.
Wright, Steven A., et al., "Modeling and Experimental Results for Condensing Supercritical CO2 Power Cycles", Sandia Report, Jan. 2011, 47 pages.
Wright, Steven A., et al., "Supercritical CO2 Power Cycle Development Summary at Sandia National Laboratories", May 24-25, 2011, (1 page, Abstract only).
Wright, Steven, "Mighty Mite", Mechanical Engineering, Jan. 2012, pp. 41-43.
Yoon, Ho Joon, et al., "Preliminary Results of Optimal Pressure Ratio for Supercritical CO2 Brayton Cycle coupled with Small Modular Water Cooled Reactor", Presentation, Korea Advanced Institute of Science and Technology and Khalifa University of Science, Technology and Research, Boulder, CO, May 25, 2011, 18 pages.
Yoon, Ho Joon, et al., "Preliminary Results of Optimal Pressure Ratio for Supercritical CO2 Brayton Cycle coupled with Small Modular Water Cooled Reactor", Paper, Korea Advanced Institute of Science and Technology and Khalifa University of Science, Technology and Research, May 24-25, 2011, Boulder, CO, 7 pages.
CN Search Report for Application No. 201080035382.1, 2 pages.
CN Search Report for Application No. 201080050795.7, 2 pages.
PCT/US2011/062198—Extended European Search Report dated May 6, 2014, 9 pages.
PCT/US2011/062201—Extended European Search Report dated May 28, 2014, 8 pages.
PCT/US2013/055547—Notification of Transmittal of the International Search Report and the Written Opinion of the International Searching Authority, or the Declaration dated Jan. 24, 2014, 11 pages.

(56) References Cited

OTHER PUBLICATIONS

PCT/US2013/064470—Notification of Transmittal of the International Search Report and the Written Opinion of the International Searching Authority, or the Declaration dated Jan. 22, 2014, 10 pages.
PCT/US2013/064471—Notification of Transmittal of the International Search Report and the Written Opinion of the International Searching Authority, or the Declaration dated Jan. 24, 2014, 10 pages.
PCT/US2014/013154—International Search Report dated May 23, 2014, 4 pages.
PCT/US2014/013170—Notification of Transmittal of the International Search Report and the Written Opinion of the International Searching Authority, or the Declaration dated May 9, 2014, 12 pages.
PCT/US2014/023026—Notification of Transmittal of the International Search Report and the Written Opinion of the International Searching Authority, or the Declaration dated Jul. 22, 2014, 11 pages.
PCT/US2014/023990—Notification of Transmittal of the International Search Report and the Written Opinion of the International Searching Authority, or the Declaration dated Jul. 17, 2014, 10 pages.
PCT/US2014/026173—Notification of Transmittal of the International Search Report and the Written Opinion of the International Searching Authority, or the Declaration dated Jul. 9, 2014, 10 pages.
Renz, Manfred, "The New Generation Kalina Cycle", Contribution to the Conference: "Electricity Generation from Enhanced Geothermal Systems", Sep. 14, 2006, Strasbourg, France, 18 pages.
Thorin, Eva, "Power Cycles with Ammonia-Water Mixtures as Working Fluid", Doctoral Thesis, Department of Chemical Engineering and Technology Energy Processes, Royal Institute of Technology, Stockholm, Sweden, 2000, 66 pages.

* cited by examiner

HEAT ENGINES WITH CASCADE CYCLES

CROSS-REFERENCE TO RELATED APPLICATIONS

This application is a continuation-in-part of U.S. patent application Ser. No. 12/631,379, filed Dec. 4, 2009, which claims priority to U.S. Provisional Patent Application Ser. No. 61/243,200, filed Sep. 17, 2009 and U.S. Provisional Patent Application Ser. No. 61/316,507, filed Mar. 23, 2010. This application also claims priority to U.S. Provisional Patent Application Ser. No. 61/417,775, filed Nov. 29, 2010. The priority applications are hereby incorporated by reference in their entirety into the present application.

BACKGROUND

Heat is often created as a byproduct of industrial processes where flowing streams of liquids, solids, and/or gasses that contain heat must be exhausted into the environment or removed in some way in an effort to maintain the operating temperatures of the industrial process equipment. Sometimes the industrial process can use heat exchangers to capture the heat and recycle it back into the process via other process streams. Other times, it is not feasible to capture and recycle this heat because it is either too low in temperature or there is no readily available systems to use the heat directly. This heat is referred to as "waste heat." Waste heat is typically discharged directly into the environment or indirectly through a cooling medium such as water. In other settings, such heat is available from renewable sources of thermal energy, such as heat from the sun (which may be concentrated or otherwise manipulated) or geothermal sources. These and other thermal energy sources are intended to fall within the definition of "waste heat" as that term is used herein.

Waste heat can be utilized by turbine-generator systems, which employ thermodynamic methods, such as the Rankine cycle, to convert heat into work. Rankine cycles are often operated with steam as the working fluid; however, a shortcoming experienced in such systems is the temperature requirement. Organic Rankine cycles (ORCs) address this challenge by replacing water with a lower boiling-point fluid working fluid, such as a light hydrocarbon, for example, propane or butane, or a HCFC, e.g. R245fa. However, the boiling heat transfer restrictions remain, and new issues such as thermal instability, toxicity, and/or flammability of the fluid are added.

Further, steam-based cycles are not always practical because they require heat source streams that are relatively high in temperature (600° F. or higher) or are large in overall heat content in order to boil the water working fluid. Further, boiling water at multiple pressures/temperatures is often required to remove sufficient levels of heat from the waste heat stream; however, such complex heat exchange can be costly in both equipment cost and operating labor.

There exists a need for a system that can efficiently and effectively produce power from waste heat from a wide range of thermal sources.

SUMMARY

Embodiments of the disclosure may provide an exemplary heat engine for recovering waste heat energy. The heat engine includes a waste heat exchanger thermally coupled to a source of waste heat and configured to heat a first flow of a working fluid, and a first expansion device configured to receive the first flow from the waste heat exchanger and to expand the first flow. The heat engine also includes a first recuperator fluidly coupled to the first expansion device and configured to receive the first flow therefrom and to transfer heat from the first flow to a second flow of the working fluid, and a second expansion device configured to receive the second flow from the first recuperator. The heat engine also includes a second recuperator fluidly coupled to the second expansion device and configured to receive the second flow therefrom and to transfer heat from the second flow to a combined flow of the first and second flows of the working fluid.

Embodiments of the disclosure may also provide an exemplary heat engine system. The heat engine system includes one or more waste heat exchangers thermally coupled to a source of waste heat, the one or more waste heat exchangers being configured to heat a first flow of working fluid. The system also includes a power turbine fluidly coupled to the one or more waste heat exchangers, the power turbine being configured to receive the first flow from the one or more waste heat expanders and to expand the first flow. The system also includes a first recuperator fluidly coupled to the power turbine, the first recuperator being configured to receive the first flow from the power turbine and to transfer heat from the first flow to a second flow of working fluid. The system further includes a second turbine fluidly coupled to the first recuperator, the second turbine being configured to receive the second flow from the first recuperator and to expand the second flow. The system also includes a second recuperator fluidly coupled to the second turbine, the second recuperator being configured to receive the second flow of working fluid from the second turbine and to transfer heat from the second flow to a combined flow of the first and second flows of the working fluid. The system further includes a condenser fluidly coupled to the first and second recuperators, the condenser being configured to receive the first and second flows from the first and second recuperators as the combined flow and to at least partially condense the combined flow. The system additionally includes a pump fluidly coupled to the condenser and to the second recuperator, the pump being configured to receive the combined flow from the condenser and pump the combined flow into the second recuperator.

Embodiments of the disclosure may further provide an exemplary method for extracting energy from a waste heat. The method includes transferring heat from the waste heat to a first flow of working fluid in a heat exchanger. The method also includes expanding the first flow in a first expander to rotate a shaft, and transferring heat from the first flow to a second flow of working fluid in a first recuperator. The method further includes expanding the second flow in a second expansion device to rotate a shaft, and transferring heat from the second flow to at least one of the first and second flows in a second recuperator. The method also includes at least partially condensing the first and second flows with one or more condensers, and pumping the first and second flows with a pump.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
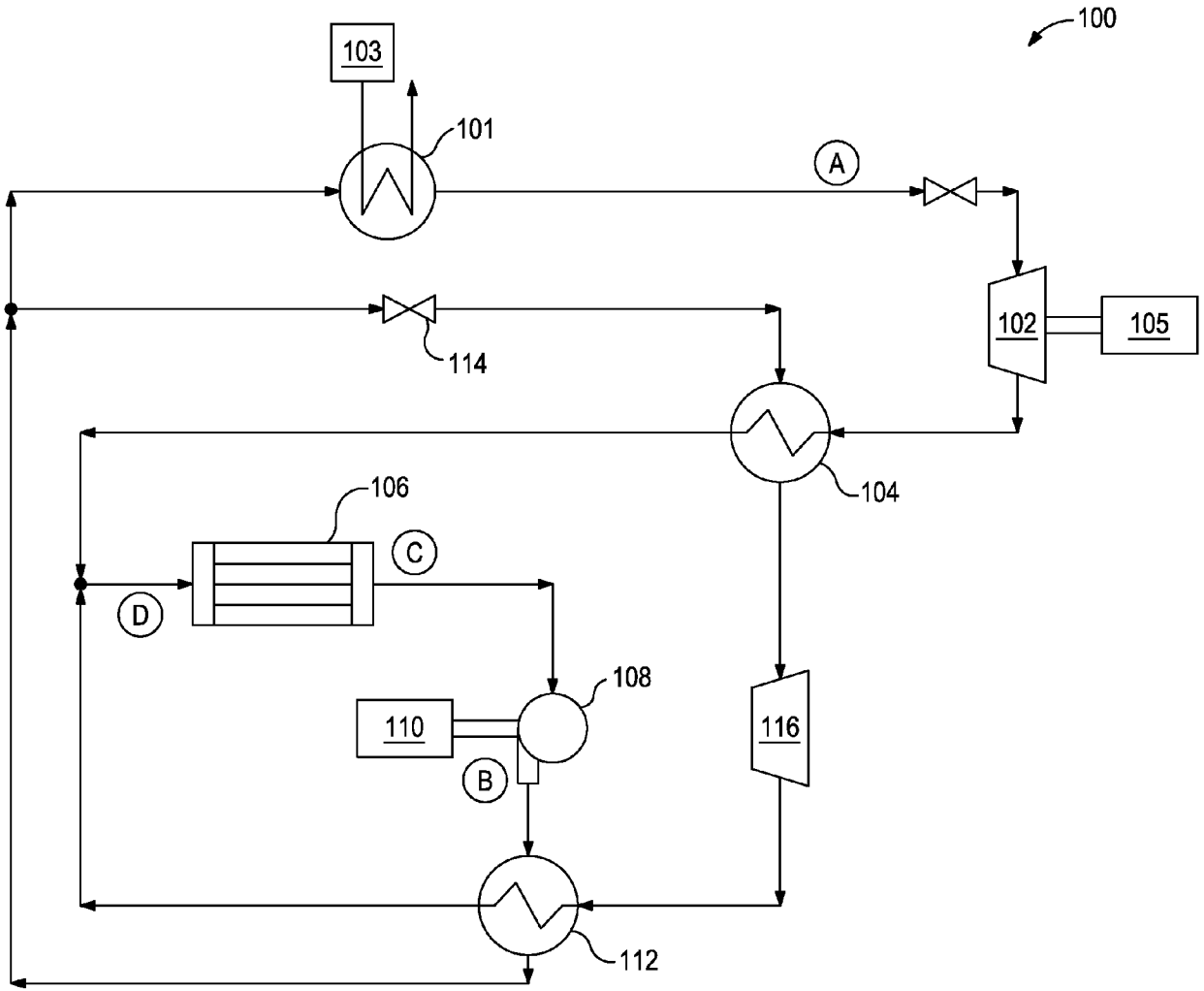
FIG. 1 illustrates a a schematic of an exemplary heat engine system, according to an embodiment.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 schematically illustrates an exemplary embodiment of a heat engine system 100 employing a "cascade" waste heat working fluid cycle. The heat engine system 100 includes a waste heat exchanger 101, which is thermally coupled to a source of waste heat 103. The source of waste heat 103 may be exhaust from another system (none shown), such as a system including a gas turbine, furnace, boiler, combustor, nuclear reactor, or the like. Additionally, the source of waste heat 103 may be a renewable energy plant, such as a solar heater, geothermal source, or the like. A low/intermediate-temperature, high-pressure first flow of working fluid may be provided to the waste heat exchanger 101, to transfer heat from the waste heat. The first flow of working fluid exiting the waste heat exchanger 101 may be a high-temperature, high-pressure first flow of working fluid.

The heat engine system 100 also includes a first expansion device 102, which is fluidly coupled to the waste heat exchanger 101 and receives the first flow of high-pressure, high-temperature working fluid therefrom. The first expansion device 102 converts energy stored in the working fluid into rotational energy, which may be employed to power a generator 105. As such, the first expansion device 102 may be referred to as a power turbine; however, the first expansion device 102 may be coupled to other devices in lieu of or in addition to the generator 105 and/or may be used to drive other components of the heat engine system 100 or other systems (not shown). Further, the first expansion device 102 may be any suitable expander, such as an axial or radial flow, single or multi-stage, impulse or reaction turbine. The working fluid is also cooled in the first expansion device 102; however, the temperature may remain close to the temperature of the working fluid upstream of the first expansion device 102. Accordingly, after pressure reduction, and a limited amount of temperature reduction, the working fluid exits the first expansion device 102 as a high-temperature, low-pressure working fluid.

Residual thermal energy in the working fluid downstream from the first expansion device 102 is at least partially transferred therefrom in a first recuperator 104. The first recuperator 102 may be any suitable type of heat exchanger, such as a shell-and-tube, plate, fin, printed circuit, or other type of heat exchanger. The first recuperator 102 may also be fluidly coupled to a second flow of high-pressure working fluid, as will be described below. Heat is transferred from the first flow of working fluid downstream of the first expansion device to the second flow of working fluid in the first recuperator 104. The first flow of working fluid thus reduces in temperature in the first recuperator 104, resulting in a low/intermediate-temperature, low-pressure first flow of working fluid at the outlet of the first recuperator 104.

The low/intermediate-temperature, low-pressure first flow of working fluid is then combined with a second flow of low/intermediate-temperature, low-pressure working fluid and directed to a condenser 106. Although both the first and second flows are identified as being "low/intermediate" in temperature, the temperatures of the two flows need not be identical. Further, it will be appreciated that the terms "high," "intermediate," "low," and combinations thereof, are used herein only to indicate temperatures relative to working fluid at other points in the cycle (e.g., "low" is less than "high") and are not to be considered indicative of a particular temperature.

The working fluid is at least partially condensed in the condenser 106, resulting in the working fluid being at least partially liquid at the outlet thereof. The condenser 106 may be any suitable heat exchanger and may be, for example, air or water-cooled from the ambient environment. Additionally or alternatively, the condenser 106 illustrated may be representative of several heat exchangers, one or more mechanical or absorption chillers, combinations thereof, or any other suitable system or device for extracting heat from the working fluid. The working fluid exiting the condenser 106 may be a low-temperature, low-pressure working fluid.

The heat engine system 100 also includes a pump 108, which may be coupled to a motor 110. The motor 110 may be any type of electrical motor and may be powered, for example, by the generator 105 and/or may be solar or wind powered. In some embodiments, the motor 102 may be a gas or diesel engine. The pump 108 may be any suitable type of pump and operates to pressurize the working fluid downstream from the condenser 106. Further, the pump 108 may increase the temperature of the working fluid by a limited amount; however, the working fluid may still have a low-temperature, relative the high-temperature working fluid exiting the waste heat exchanger 101, for example. Accordingly, working fluid exiting the pump 108 may be a low-temperature, high-pressure working fluid.

The heat engine system 100 may also include a second recuperator 112, which is fluidly coupled to the pump 108. The second recuperator 112 may be any suitable type of heat exchanger and may function to transfer heat from the aforementioned second flow of working fluid to the low-temperature, high-pressure working fluid downstream from the pump 108. Accordingly, the working fluid exiting the second recuperator 112 may be a low/intermediate-temperature, high-pressure working fluid. At least a portion of the intermediate-temperature, high-pressure working fluid is routed from the second recuperator 112 to the waste heat exchanger 101, thereby closing one loop on the heat engine system 100.

Another portion of the low/intermediate-temperature, high-pressure working fluid may, however, be diverted to provide the aforementioned second flow of working fluid. The amount of working fluid diverted (and/or whether the working fluid is diverted) may be controlled by a valve 114. The valve 114 may be a throttle valve, a control valve, gate valve, combinations thereof, or any other suitable type of valve, for example, depending on whether flow rate control is desired in the heat engine system 100.

The valve 114 is fluidly coupled to the first recuperator 104; accordingly, the second flow of working fluid, which is low/intermediate-temperature, high-pressure working fluid at this point, is directed from the valve 114 to the first recuperator 104. In the first recuperator 104, the low/intermediate-temperature, high-pressure second flow of the working fluid absorbs heat from the high-temperature, low-pressure first flow of the working fluid downstream from the first expansion device 102. Accordingly, the second flow of working fluid exiting the first recuperator 104 is a high/intermediate-temperature, high-pressure working fluid. For example, the high/intermediate-temperature, high-pressure working fluid of the second flow of working fluid may be within about 5-10° C. of the first flow of working fluid upstream or downstream from the first recuperator 104.

The heat engine system 100 also includes a second expansion device 116, which may be any suitable type of expander, such a turbine. The second expansion device 116 may be coupled to a generator 118 and/or any other device configured to receive mechanical energy from the second expansion device 116 such as, but not limited to, another component of the heat engine system 100. In an exemplary embodiment, the first and second expansion devices 102, 116 may be separate units or may be stages of a single turbine. For example, the first and second expansion devices 102, 116 may be separate stages of a radial turbine driving a bull gear and using separate pinions for each radial turbine stage. In another example, the first and second expansion devices 102, 116 may be separate units on a common shaft. Additionally, the generators 103, 118 may be combined in some embodiments, such that a single generator receives power input from both of the first and second expansion devices 102, 116.

The second flow of working fluid, having been expanded in the second expansion device 116, may be a high/intermediate-temperature, low-pressure working fluid exiting the second expansion device 116. This second flow of working fluid may then be routed to the second recuperator 112. Accordingly, the first and second recuperators 104, 112 may be described as being "in series," meaning a flowpath proceeds from the first recuperator 104 to the second recuperator 112 (via any components disposed therebetween, as necessary), rather than the flow being split upstream of the first and second recuperator 104, 112 and then being fed to the two recuperators 104, 112 in parallel.

In the second recuperator 112, the second flow of working fluid transfers thermal energy to the working fluid exiting the pump 108, to preheat the working fluid from the pump 108, prior to its recycling back to the waste heat exchanger 101. As a result, the second flow of working fluid is cooled to a low/intermediate temperature, low-pressure working fluid. The second flow of working fluid is then combined with the first mass flow of working fluid downstream from the first recuperator 104, and the combined flow is then directed to the condenser 106, as described above.

By using two (or more) expansion devices 102, 116 at similar pressure ratios, a larger fraction of the available heat source is utilized and residual heat therefrom is recuperated. The arrangement of the recuperators 104, 112 can be optimized with the waste heat to maximize power output of the multiple temperature expansions. Also, the two sides of the recuperators 104, 112 may be balanced, for example by matching heat capacity rates (C=mass flow rate×specific heat) by selectively merging the various flows in the working fluid circuits as illustrated and described.

Figure 2:
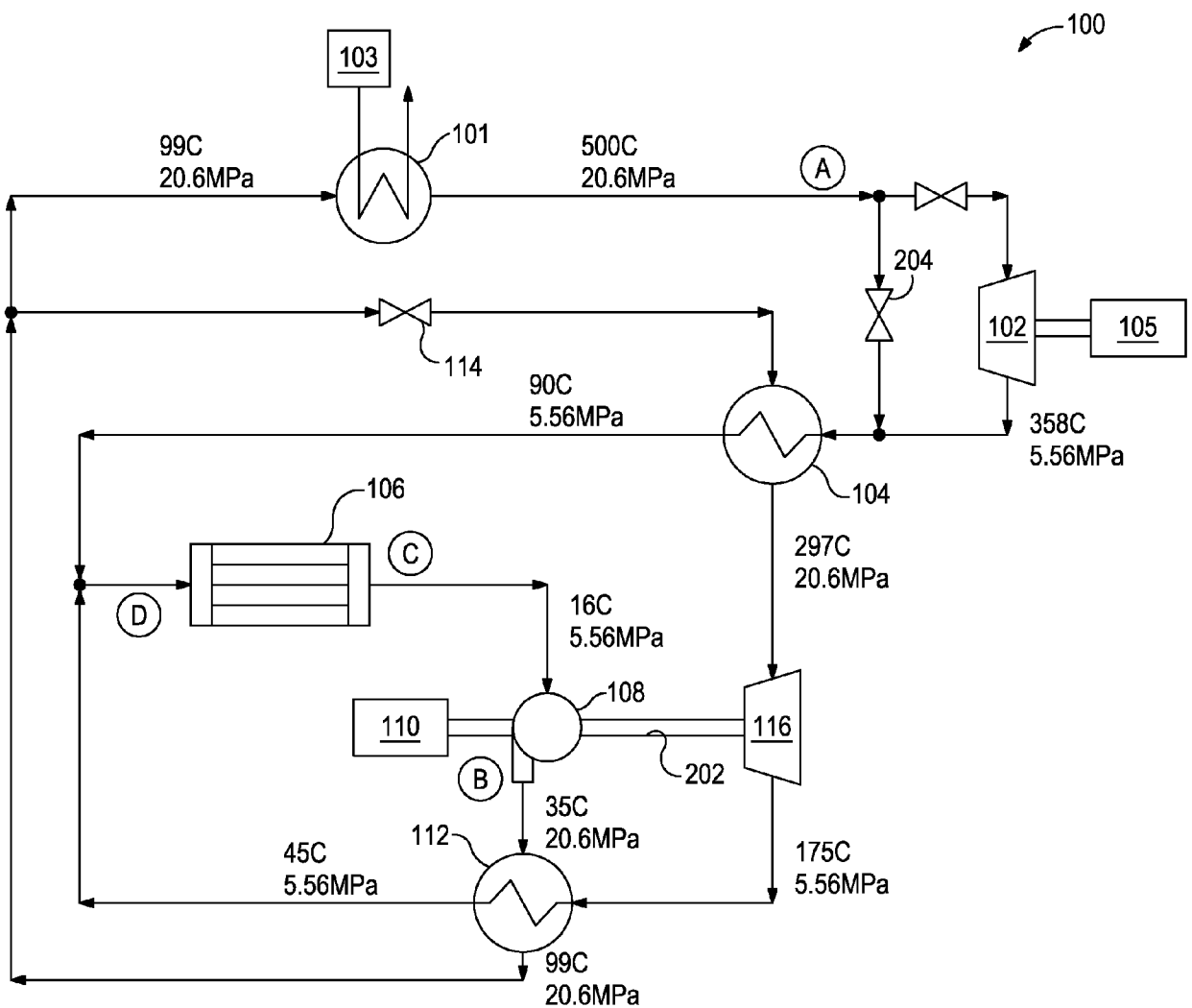
FIG. 2 illustrates a schematic of another exemplary embodiment of the heat engine system.

FIG. 2 illustrates another exemplary embodiment of the heat engine system 100. In this embodiment, the second expansion device 116 may be coupled to the pump 108 via a shaft 202, to drive the pump 108. It will be appreciated that the second expansion device 116 and the pump 108 may be separated by a gearbox or another speed changing device, or may be directly coupled together, as determined by component selection, flow conditions, etc. Further, the pump 108 may continue to be driven by the motor 110, with the motor 110 being used to provide power during system startup, for example. Additionally, the motor 110 may provide a fraction of the drive load for the pump 108 under some conditions. In some embodiments, the motor 110 may be capable of receiving power, thereby functioning as a generator when the second expansion device 116 produces more power than the pump 108 requires for operation. In such case, the motor 110 may be referred to as a motor/generator, as is known in the art. Further, this arrangement may obviate a need for a separate generator 118 (FIG. 1) coupled to the second expansion device 116.

As also indicated in FIG. 2, the system 100 may include a bypass valve 204. The bypass valve 204 may be opened during startup, to achieve steady-state operation prior to activation of the first expansion device. Once started, the bypass valve 204 may be closed, such that the working fluid is directed to the first expansion device 102.

Additionally, FIG. 2 provides approximate values for the different fluid temperatures and pressures between components. It will be appreciated that all values shown are approximations and are illustrative of but one example, among many contemplated herein, of working fluid conditions. Further, such conditions are expected to vary widely according to a variety of factors, including waste heat temperature and flow rate as well as working fluid composition and component selection and should, therefore, not be considered limiting on the present disclosure unless otherwise expressly indicated.

Figure 3:
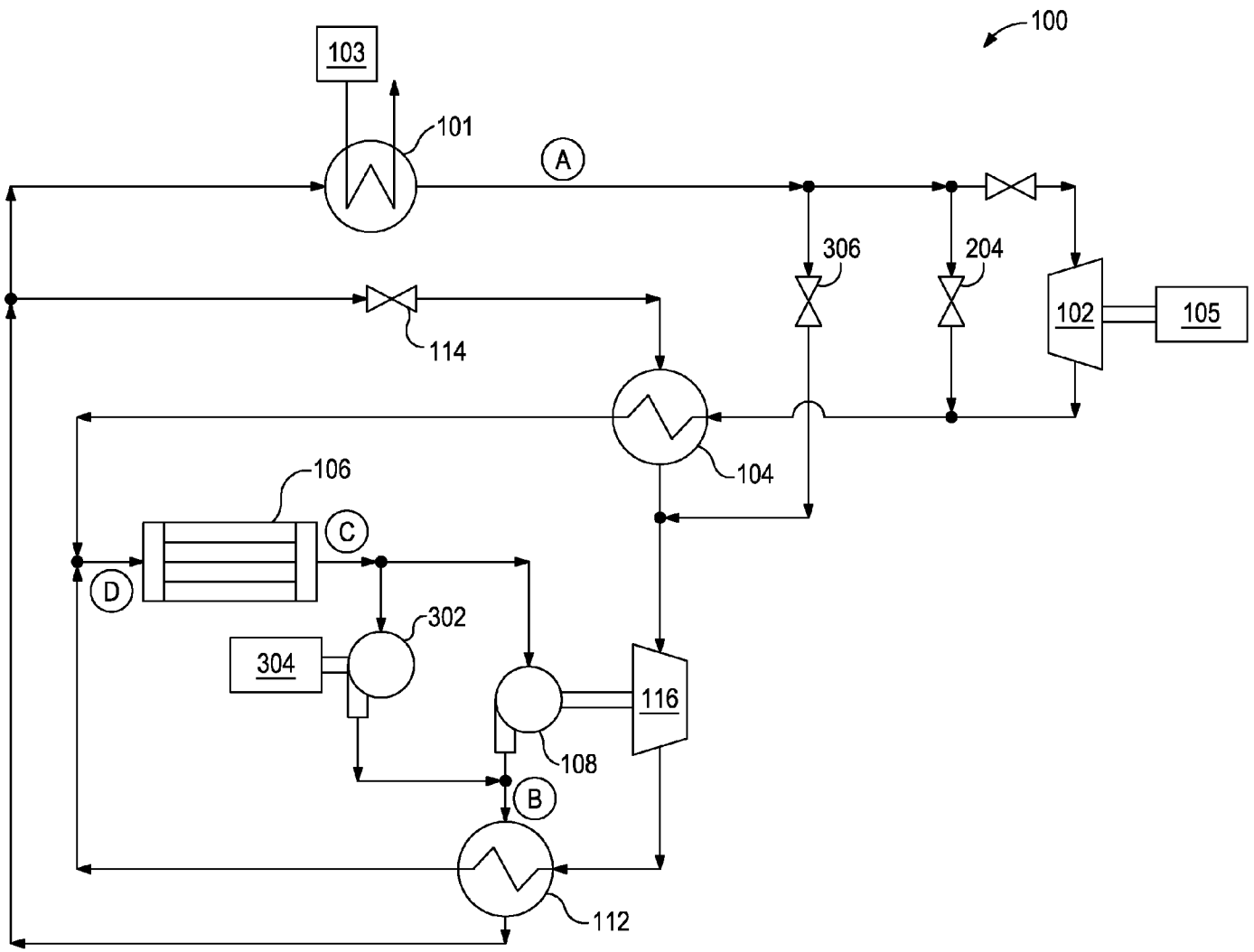
FIG. 3 illustrates a schematic of still another exemplary embodiment of the heat engine system.

FIG. 3 illustrates another exemplary embodiment of the heat engine system 100, which may be similar to the heat engine system 100 described above. In the illustrated embodiment, the pump 108 may be a high-speed, direct-drive turbopump, again coupled to the second expansion device 116 via the shaft 202. In this case, a small "starter pump" 302 or other pumping device is used during system startup. The starter pump 302 may be driven by a relatively small electric motor 304. Once the second expansion device 116, in this case, driving the pump 108, is generating sufficient power to "bootstrap" itself into steady-state operation, the starter pump 302 can be shut down. In this case, a valve 306, along with the valve 114 and the bypass valve 204, are provided to short-circuit the heat engine system 100 and to operate the pump 108 under varying load conditions. The short-circuiting also heats the pump 108 by routing the fluid around the first recuperator prior to the first expansion device 102 starting.

In the described cycles one preferred working fluid is carbon dioxide. The use of the term carbon dioxide is not intended to be limited to carbon dioxide of any particular type, purity or grade of carbon dioxide. For example, the working fluid may be industrial grade carbon dioxide. Carbon dioxide is a greenhouse friendly and neutral working fluid that offers benefits such as non-toxicity, non-flammability, easy availability, low price, and no need of recycling.

In the described cycles the working fluid is in a supercritical state over certain portions of the system (the "high-pressure side"), and in a subcritical state at other portions of the system (the "low-pressure side"). In other embodiments, the entire cycle may be operated such that the working fluid is in a supercritical or subcritical state during the entire execution of the cycle. The working fluid may a binary, ternary or other working fluid blend. The working fluid combination can be selected for the unique attributes possessed by the fluid combination within a heat recovery system as described herein. For example, one such fluid combination is comprised of a liquid absorbent and carbon dioxide enabling the combined fluid to be pumped in a liquid state to high-pressure with less energy input than required to compress $CO_2$. In another embodiment, the working fluid may be a combination of carbon dioxide and one or more other miscible fluids. In other embodiments, the working fluid may be a combination of carbon dioxide and propane, or carbon dioxide and ammonia.

One of ordinary skill in the art will recognize that using the term "working fluid" is not intended to limit the state or phase of matter that the working fluid is in. In other words, the working fluid may be in a fluid phase, a gas phase, a supercritical phase, a subcritical state or any other phase or state at any one or more points within the cycle.

To provide proper functioning of the pump 108, the pressure at the pump inlet must exceed the vapor pressure of the working fluid by a margin sufficient to prevent vaporization of the fluid at the local regions of the low-pressure and/or high velocity. This is especially important with high speed pumps such as the turbopumps used in the various and preferred embodiments. Thus a traditional passive system, such as a surge tank, which only provides the incremental pressure of gravity relative to the fluid vapor pressure, may be insufficient for the embodiments disclosed herein.

The disclosure and related inventions may further include the incorporation and use of a mass management system in connection with or integrated into the described thermodynamic cycles. A mass management system is provided to control the inlet pressure at the pump by adding and removing mass from the system, and this in turn makes the system more efficient. In a preferred embodiment, the mass management system operates with the system semi-passively. The system uses sensors to monitor pressures and temperatures within the high-pressure side (from pump outlet to expander inlet) and low-pressure side (from expander outlet to pump inlet) of the system. The mass management system may also include valves, tank heaters or other equipment to facilitate the movement of the working fluid into and out of the system and a mass control tank for storage of working fluid.

Figure 4:
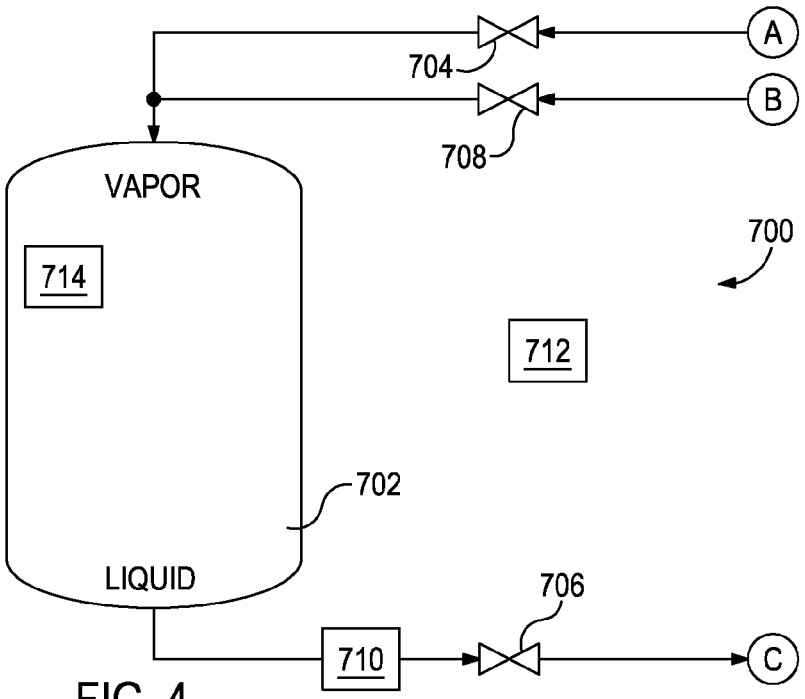
FIG. 4 is a schematic of an exemplary mass management system (MMS), which may be used with the heat engine systems of FIGS. 1, 2, and/or 3, according to one or more embodiments.
Figure 5:
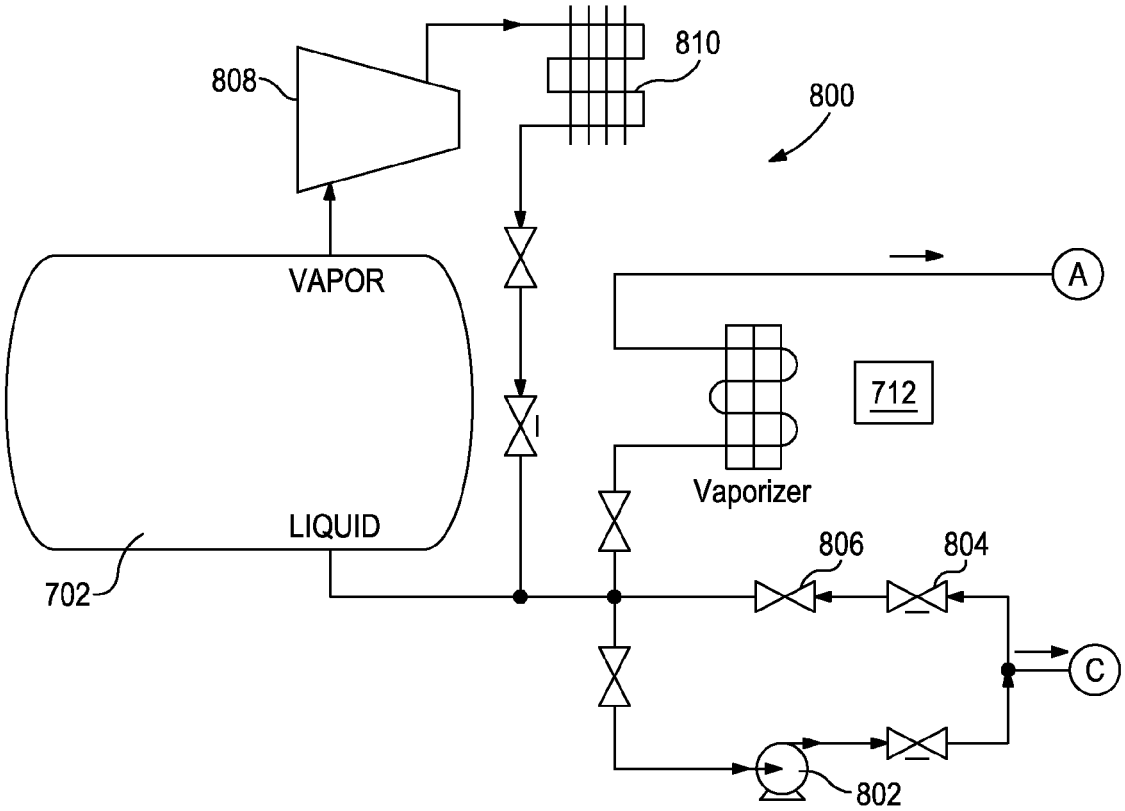
FIG. 5 is a schematic of another exemplary embodiment of the mass management system (MMS).

Referring now to FIGS. 4 and 5, illustrated are exemplary mass management systems 700 and 800, respectively, which may be used in conjunction with the heat engine system 100 embodiments described herein. System tie-in points A, B, and C as shown in FIGS. 4 and 5 (only points A and C shown in FIG. 5) correspond to the system tie-in points A, B, and C shown in FIGS. 1-3. Accordingly, MMS 700 and 800 may each be fluidly coupled to the heat engine system 100 of FIGS. 1-3 at the corresponding system tie-in points A, B, and C (if applicable). The exemplary MMS 800 stores a working fluid at low (sub-ambient) temperature and therefore low pressure, and the exemplary MMS 700 stores a working fluid at or near ambient temperature. As discussed above, the working fluid may be $CO_2$, but may also be other working fluids without departing from the scope of the disclosure.

In exemplary operation of the MMS 700, a working fluid storage reservoir or tank 702 is pressurized by tapping working fluid from the working fluid circuit(s) of the heat engine system 100 through a first valve 704 at tie-in point A. When needed, additional working fluid may be added to the working fluid circuit by opening a second valve 706 arranged near the bottom of the storage tank 702 in order to allow the additional working fluid to flow through tie-in point C, arranged upstream from the pump 108 (FIGS. 1-3). Adding working fluid to the heat engine system 100 at tie-in point C may serve to raise the inlet pressure of the pump 108. To extract fluid from the working fluid circuit, and thereby decrease the inlet pressure of the pump 108, a third valve 708 may be opened to permit cool, pressurized fluid to enter the storage tank via tie-in point B. While not necessary in every application, the MMS 700 may also include a transfer pump/compressor 710 configured to remove working fluid from the tank 702 and inject it into the working fluid circuit.

Figure 8:
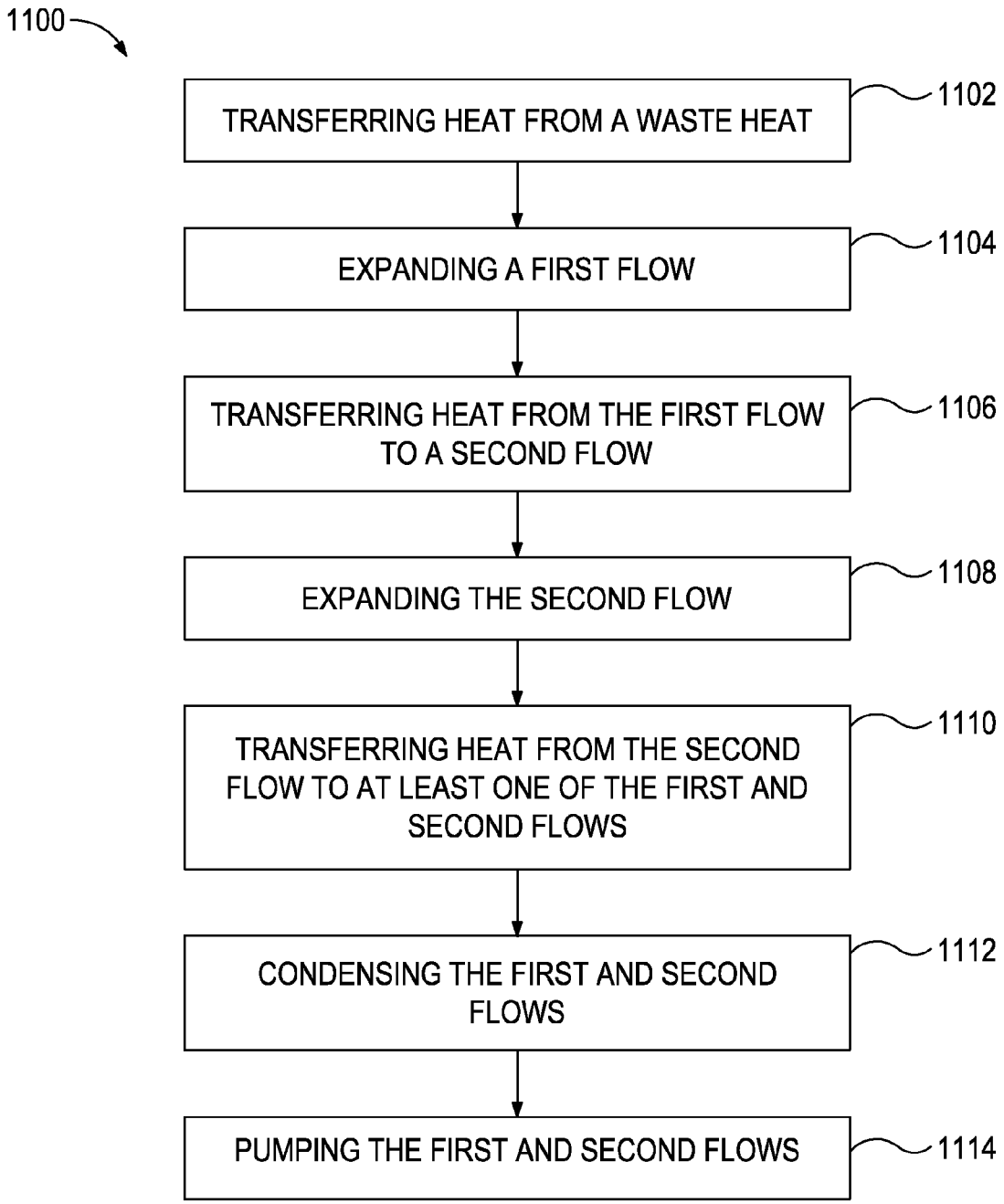
FIG. 8 illustrates a flowchart of an exemplary method for extracting energy from a waste heat.

The MMS 800 of FIG. 8 uses only two system tie-ins or interface points A and C. The valve-controlled interface A is not used during the control phase (e.g., the normal operation of the unit), and is provided only to pre-pressurize the working fluid circuit with vapor so that the temperature of the circuit remains above a minimum threshold during fill. A vaporizer may be included to use ambient heat to convert the liquid-phase working fluid to approximately an ambient temperature vapor-phase of the working fluid. Without the vaporizer, the system could decrease in temperature dramatically during filling. The vaporizer also provides vapor back to the storage tank 702 to make up for the lost volume of liquid that was extracted, and thereby acting as a pressure-builder. In at least one embodiment, the vaporizer can be electrically-heated or heated by a secondary fluid. In operation, when it is desired to increase the suction pressure of the pump 108 (FIGS. 1-3), working fluid may be selectively added to the working fluid circuit by pumping it in with a transfer pump/compressor 802 provided at or proximate tie-in C. When it is desired to reduce the suction pressure of the pump 108, working fluid is selectively extracted from the system at interface C and expanded through one or more valves 804 and 806 down to the relatively low storage pressure of the storage tank 702.

Under most conditions, the expanded fluid following the valves 804, 806 will be two-phase (i.e., vapor+liquid). To prevent the pressure in the storage tank 702 from exceeding its normal operating limits, a small vapor compression refrigeration cycle, including a vapor compressor 808 and accompanying condenser 810, may be provided. In other embodiments, the condenser can be used as the vaporizer, where condenser water is used as a heat source instead of a heat sink. The refrigeration cycle may be configured to decrease the temperature of the working fluid and sufficiently condense the vapor to maintain the pressure of the storage tank 702 at its design condition. As will be appreciated, the vapor compression refrigeration cycle may be integrated within MMS 800, or may be a stand-alone vapor compression cycle with an independent refrigerant loop.

The working fluid contained within the storage tank 702 will tend to stratify with the higher density working fluid at the bottom of the tank 702 and the lower density working fluid at the top of the tank 702. The working fluid may be in liquid phase, vapor phase or both, or supercritical; if the working fluid is in both vapor phase and liquid phase, there will be a phase boundary separating one phase of working fluid from the other with the denser working fluid at the bottom of the storage tank 702. In this way, the MMS 700, 800 may be capable of delivering to the circuits 110-610 the densest working fluid within the storage tank 702.

All of the various described controls or changes to the working fluid environment and status throughout the working fluid circuit, including temperature, pressure, flow direction and rate, and component operation such as pump 108, secondary pumps 302, and first and second expansion devices 102, 116, may be monitored and/or controlled by a control system 712, shown generally in FIGS. 4 and 5. Exemplary control systems compatible with the embodiments of this disclosure are described and illustrated in co-pending U.S. patent application Ser. No. 12/880,428, entitled "Heat Engine and Heat to Electricity Systems and Methods with Working Fluid Fill System," filed on Sep. 13, 2010, and incorporated by reference, as indicated above.

In one exemplary embodiment, the control system 712 may include one or more proportional-integral-derivative (PID) controllers as control loop feedback systems. In another exemplary embodiment, the control system 712 may be any microprocessor-based system capable of storing a control program and executing the control program to receive sensor inputs and generate control signals in accordance with a predetermined algorithm or table. For example, the control system 712 may be a microprocessor-based computer running a control software program stored on a computer-readable medium. The software program may be configured to receive sensor inputs from various pressure, temperature, flow rate, etc. sensors positioned throughout the working fluid circuits 110-610 and generate control signals therefrom, wherein the control signals are configured to optimize and/or selectively control the operation of the working fluid circuit.

Each MMS 700, 800 may be communicably coupled to such a control system 712 such that control of the various valves and other equipment described herein is automated or semi-automated and reacts to system performance data obtained via the various sensors located throughout the working fluid circuit, and also reacts to ambient and environmental conditions. That is to say that the control system 712 may be in communication with each of the components of the MMS 700, 800 and be configured to control the operation thereof to accomplish the function of the heat engine system 100 more efficiently. For example, the control system 712 may be in communication (via wires, RF signal, etc.) with each of the valves, pumps, sensors, etc. in the system and configured to control the operation of each of the components in accordance with a control software, algorithm, or other predetermined control mechanism. This may prove advantageous to control temperature and pressure of the working fluid at the inlet of the pump 108, to actively increase the suction pressure of the pump 108 by decreasing compressibility of the working fluid. Doing so may avoid damage to the pump 108 (e.g., by avoiding cavitation) as well as increase the overall pressure ratio of the heat engine system 100, thereby improving the efficiency and power output.

In one or more exemplary embodiments, it may prove advantageous to maintain the suction pressure of the pump 108 above the boiling pressure of the working fluid at the inlet of the pump 108. One method of controlling the pressure of the working fluid in the low-temperature side of the heat engine system 100 is by controlling the temperature of the working fluid in the storage tank 702 of FIG. 4. This may be accomplished by maintaining the temperature of the storage tank 702 at a higher level than the temperature at the inlet of the pump 108. To accomplish this, the MMS 700 may include the use of a heater and/or a coil 714 within the tank 702. The heater/coil 714 may be configured to add or remove heat from the fluid/vapor within the tank 702. In one exemplary embodiment, the temperature of the storage tank 702 may be controlled using direct electric heat. In other exemplary embodiments, however, the temperature of the storage tank 702 may be controlled using other devices, such as but not limited to, a heat exchanger coil with pump discharge fluid (which is at a higher temperature than at the pump inlet), a heat exchanger coil with spent cooling water from the cooler/condenser (also at a temperature higher than at the pump inlet), or combinations thereof.

Figure 6:
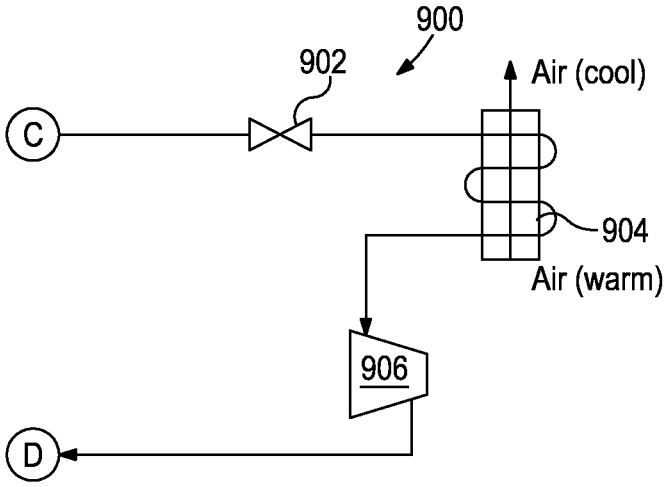
FIGS. 6 and 7 schematically illustrate arrangements for inlet chilling of a separate fluid stream (e.g., air), according to embodiments of the disclosure.
Figure 7:
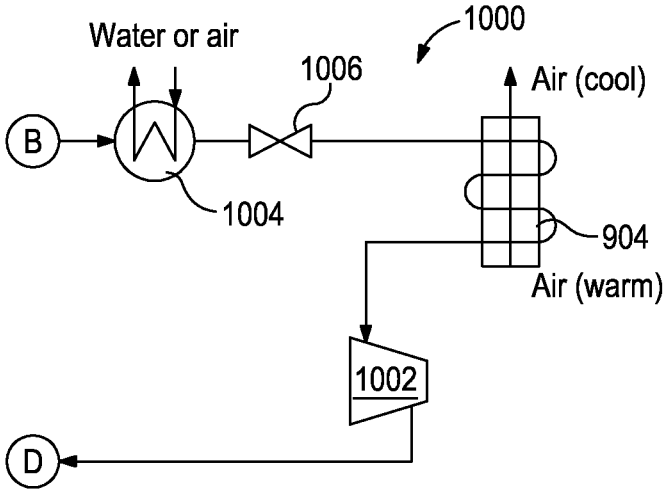

Referring now to FIGS. 6 and 7, chilling systems 900 and 1000, respectively, may also be employed in connection with any of the above-described cycles in order to provide cooling to other areas of an industrial process including, but not limited to, pre-cooling of the inlet air of a gas-turbine or other air-breathing engines, thereby providing for a higher engine power output. System tie-in points B and D or C and D in FIGS. 6 and 7 may correspond to the system tie-in points B, C, and D in FIGS. 1-3. Accordingly, chilling systems 900, 1000 may each be fluidly coupled to the heat engine system 100 at the corresponding system tie-in points B, C, and/or D (where applicable).

FIG. 8 illustrates an exemplary method 1100 for extracting energy from a waste heat. The method 1100 may proceed by operation of one or more of the embodiments of the heat engine system 100 described above and may thus be best understood with reference thereto. The method 1100 includes transferring heat from the waste heat to a first flow of working fluid in a heat exchanger, as at 1102. The method 1100 also includes expanding the first flow in a first expander to rotate a shaft, as at 1104. The method 1100 further includes transferring heat from the first flow to a second flow of working fluid in a first recuperator, as at 1106. The method 1100 also includes expanding the second flow in a second expansion device to rotate a shaft, as at 1108. The method 1100 further includes transferring heat from the second flow to at least one of the first and second flows (e.g., both in a combined flow) in a second recuperator, as at 1110. The method 1100 also includes at least partially condensing the first and second flows with one or more condensers, as at 1112. The method 1000 additionally includes pumping the first and second flows with a pump, as at 1114. In an exemplary embodiment, expanding the second flow in the second expansion device to rotate the shaft, as at 1108, additionally includes driving the pump.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A heat engine for recovering waste heat energy, comprising:

a waste heat exchanger thermally coupled to a source of waste heat and configured to heat a first flow of a working fluid;

a first expansion device configured to receive the first flow from the waste heat exchanger and to expand the first flow;

a first recuperator fluidly coupled to the first expansion device and configured to receive the first flow therefrom and to transfer heat from the first flow to a second flow of the working fluid;

a second expansion device configured to receive the second flow from the first recuperator and to expand the second flow; and a second recuperator fluidly coupled to the second expansion device and configured to receive the second flow therefrom and to transfer heat from the second flow to a combined flow of the first and second flows of the working fluid.

2. The heat engine of claim 1, further comprising a condenser and a pump, the condenser and the pump being positioned upstream from the second recuperator and configured to provide the combined flow thereto.

3. The heat engine of claim 2, wherein the condenser is positioned downstream from the first and second recuperators, and the first and second flows are combined to form the combined flow of working fluid upstream from the condenser.

4. The heat engine of claim 2, wherein the second expansion device is configured to drive the pump.

5. The heat engine of claim 4, further comprising a starter pump positioned downstream from the condenser and upstream from the second recuperator.

6. The heat engine of claim 2, further comprising a mass management system to control a working fluid pressure at the pump.

7. The heat engine of claim 2, further comprising a working fluid reservoir connected to a first point between the waste heat exchangers and the first expansion device, and to a second point downstream from the condenser and upstream of the pump.

8. The heat engine of claim 2, further comprising a working fluid chilling system configured to draw and compress the working fluid from upstream of the pump, and to deliver the working fluid to the condenser.

9. The heat engine of claim 1, wherein the working fluid is carbon dioxide that is in the supercritical state in at least one point in the heat engine system.

10. The heat engine of claim 1, wherein the first and second recuperators are arranged in series downstream from the first expansion device.

11. The heat engine of claim 10, wherein the second expansion device receives working fluid from a pump, through the first and second recuperators.

12. A heat engine system, comprising:

one or more waste heat exchangers thermally coupled to a source of waste heat, the one or more waste heat exchangers being configured to heat a first flow of working fluid;

a power turbine fluidly coupled to the one or more waste heat exchangers, the power turbine being configured to receive the first flow from the one or more waste heat expanders and to expand the first flow;

a first recuperator fluidly coupled to the power turbine, the first recuperator being configured to receive the first flow from the power turbine and to transfer heat from the first flow to a second flow of working fluid;

a second turbine fluidly coupled to the first recuperator, the second turbine being configured to receive the second flow from the first recuperator and to expand the second flow;

a second recuperator fluidly coupled to the second turbine, the second recuperator being configured to receive the second flow of working fluid from the second turbine and to transfer heat from the second flow to a combined flow of the first and second flows of the working fluid;

a condenser fluidly coupled to the first and second recuperators, the condenser being configured to receive the first and second flows from the first and second recuperators, respectively, as the combined flow and to at least partially condense the combined flow; and a pump fluidly coupled to the condenser and to the second recuperator, the pump being configured to receive the combined flow from the condenser and pump the combined flow into the second recuperator.

13. The heat engine system of claim 12, wherein the second recuperator is fluidly coupled to the one or more waste heat exchangers and to the first recuperator, wherein the first and second flows are separated downstream from the second recuperator, such that the first flow is introduced to the one or more waste heat exchangers and the second flow is introduced to the first recuperator.

14. The heat engine system of claim 12, wherein the second turbine includes a drive turbine coupled to the pump, to drive the pump.

15. The heat engine system of claim 14, further comprising a motor/generator coupled to the pump, to provide a fraction of the driving force to the pump, to convert excess power from the drive turbine to electricity, or both.

16. The heat engine system of claim 12, further comprising a plurality of valves, at least one of the plurality of valves being configured, when opened, to direct the first flow to bypass the first expansion device, and at least one of the plurality of valves being configured, when opened, to direct the working fluid to bypass the first expansion device and the first recuperator.

17. The heat engine system of claim 16, wherein the plurality of valves further includes at least one valve configured to control the mass flow of the second flow of the working fluid.

18. A method for extracting energy from a waste heat, comprising:

transferring heat from the waste heat to a first flow of working fluid in a heat exchanger;

expanding the first flow in a first expander to rotate a shaft;

transferring heat from the first flow to a second flow of working fluid in a first recuperator;

expanding the second flow in a second expansion device to rotate a shaft;

transferring heat from the second flow to at least one of the first and second flows in a second recuperator;

at least partially condensing the first and second flows with one or more condensers; and pumping the first and second flows with a pump.

19. The method of claim 18, further comprising combining first and second flows prior to condensing, to provide a combined flow to the condenser.

20. The method of claim 19, wherein expanding the second flow in the second expansion device to rotate the shaft further comprises driving the pump.

21. A heat engine system, comprising:

a working fluid circuit configured to flow a working fluid therethrough and comprising:

a pump configured to circulate the working fluid through the working fluid circuit, wherein the working fluid is split into a first portion and a second portion downstream of the pump;

a first loop comprising a waste heat exchanger configured to transfer heat from waste heat to the first portion of the working fluid, a first expansion device configured to expand the first portion of the working fluid, and a first recuperator downstream of the first expansion device and configured to transfer heat from the first portion of the working fluid to the second portion of the working fluid; and a second loop comprising the first recuperator, a second expansion device disposed downstream of the first recuperator and configured to expand the second portion of the working fluid, and a second recuperator configured to transfer heat from the second portion of the working fluid to at least one of the first portion and the second portion of the working fluid downstream of the pump.

22. The heat engine system of claim 21, wherein the working fluid circuit comprises a condenser downstream of the first recuperator and the second recuperator and configured to receive a combined flow of the first portion and the second portion of the working fluid.

* * * * *